US005203628A

United States Patent [19]

Hamm

[11] Patent Number: 5,203,628

[45] Date of Patent: Apr. 20, 1993

[54] PORTABLE BATCH MIXING APPARATUS FOR CEMENTITIOUS CONSTRUCTION MATERIALS

[75] Inventor: Alton B. Hamm, Fort Worth, Tex.

[73] Assignee: Hamm Family Partnership, Ft. Worth, Tex.

[21] Appl. No.: 537,475

[22] Filed: Jun. 13, 1990

Related U.S. Application Data

[63] Continuation-in-part of Ser. No. 252,379, Sep. 30, 1988, abandoned.

[51] Int. Cl.[5] ..... B01F 13/10

[52] U.S. Cl. ..... 366/2; 366/20; 366/40

[58] Field of Search ..... 366/17, 18, 19, 20, 366/21, 38, 40, 1, 2

[56] References Cited

U.S. PATENT DOCUMENTS

| | | | |
|---|---|---|---|
| 736,389 | 8/1903 | Haskins . | |
| 1,152,820 | 9/1915 | Kennicott . | |
| 1,565,688 | 12/1925 | Tranaas . | |
| 1,577,635 | 3/1926 | Essick . | |
| 1,699,230 | 1/1929 | Eberling . | |
| 1,724,033 | 8/1929 | Lichtenberg . | |
| 1,775,746 | 9/1930 | Yett | 366/18 |
| 2,015,488 | 9/1935 | Manabe | 83/73 |
| 2,493,898 | 1/1950 | Pollitz | 366/18 |
| 2,687,285 | 8/1954 | Fisher | 366/18 |
| 3,152,842 | 10/1964 | Anderson et al. | 302/53 |
| 3,162,316 | 12/1964 | Camp | 366/18 |
| 3,305,222 | 2/1967 | Foster . | |
| 3,306,589 | 2/1967 | Uden . | |
| 3,343,688 | 9/1967 | Ross | 214/2 |
| 3,363,806 | 1/1968 | Blakeslee et al. | 222/70 |
| 3,451,659 | 6/1969 | Tobolov . | |
| 3,458,177 | 7/1969 | Farnham et al. | 366/1 |
| 3,540,633 | 11/1970 | Eckhardt | 222/195 |
| 3,619,011 | 11/1971 | Doble | 302/53 |
| 3,625,489 | 12/1971 | Weaver . | |
| 3,658,301 | 4/1972 | Brunsing et al. . | |
| 3,756,475 | 9/1973 | Emery | 222/195 |
| 3,820,762 | 6/1974 | Bostrom | 366/18 |

(List continued on next page.)

FOREIGN PATENT DOCUMENTS 592454 2/1978 U.S.S.R. .

OTHER PUBLICATIONS

The Magazine of Masonry Construction Jul. 1988.

*Primary Examiner*—Frankie L. Stinson

*Attorney, Agent, or Firm*—Hubbard, Thurman, Tucker & Harris

[57] ABSTRACT

A portable system for on-site batch mixing of cementitious materials, such as mortar and grout, includes a batch mixing machine for metering and mixing cement, sand and water, a cement storage silo sized to hold at least one commercial delivery truckload of cement, and a pair of sand supporting ground pads. The large cement storage silo significantly reduces the manpower and equipment costs associated with the overall batch mixing process, and the sand support pads operate to prevent dirt contamination of the cementitious mixture. The water storage portion is provided with a simplified, floatless fill level control system and an improved water heating system which significantly reduces water temperature stratification. A specially designed pressurized shaft bearing/seal structure provided on the batch mixer portion of the mixing machine reduces grease and seal maintenance and functions to essentially preclude entry of cementitious material into the shaft bearing. The cement reservoir hopper portion of the batch mixing machine has incorporated therein a cement conditioning system providing improved cement discharge metering accuracy, the conditioning system including a vertical air discharge pipe connected at its lower end to an air gatherer disposed above air discharge members which fluff the cement located above the bottom hopper outlet and below the air gatherer. In an alternate embodiment, the cement reservoir hopper and its associated cement conditioning system are removed from the mixing machine and incorporated in the cement storage silo.

26 Claims, 4 Drawing Sheets

U.S. PATENT DOCUMENTS

| | | | |
|---|---|---|---|
| 3,829,022 | 8/1974 | Reiter | 239/288.5 |
| 3,942,772 | 3/1976 | Smith . | |
| 3,987,937 | 10/1976 | Coucher | 222/193 |
| 3,995,839 | 12/1976 | Zingg . | |
| 4,023,776 | 5/1977 | Greten . | |
| 4,083,475 | 4/1978 | Venner et al. | 222/198 |
| 4,187,030 | 2/1980 | Godley | 366/319 |
| 4,272,824 | 6/1981 | Lewinger et al. | 364/502 |
| 4,334,786 | 6/1982 | Delcoigne et al. | 366/132 |
| 4,339,202 | 7/1982 | Hart et al. | 366/8 |
| 4,339,204 | 7/1982 | Placzek | 366/18 |
| 4,353,668 | 10/1982 | Anderson | 406/90 |
| 4,367,953 | 1/1983 | Hinz et al. | 366/132 |
| 4,390,282 | 6/1983 | Bake | 366/40 |
| 4,406,548 | 9/1983 | Haws | 366/8 |
| 4,409,096 | 10/1983 | O'Brian | 209/10 |
| 4,412,762 | 11/1983 | Lepley et al. | 406/134 |
| 4,488,815 | 12/1984 | Black | 366/8 |
| 4,502,820 | 3/1985 | Fujii et al. | 406/56 |
| 4,544,279 | 10/1985 | Rudolph | 366/132 |
| 4,548,507 | 10/1985 | Mathis et al. | 366/20 |
| 4,580,902 | 4/1986 | Dunston | 366/33 |
| 4,660,987 | 4/1987 | Robinson | 366/67 |
| 4,667,503 | 5/1987 | Loos | 73/3 |
| 4,792,234 | 12/1988 | Doherty | 366/18 X |
| 4,855,960 | 8/1989 | Janssen et al. | 366/19 X |

PORTABLE BATCH MIXING APPARATUS FOR CEMENTITIOUS CONSTRUCTION MATERIALS

CROSS-REFERENCE TO RELATED APPLICATION

This application is a continuation-in-part of copending U.S. application Ser. No. 252,379 now abandoned which was filed on Sep. 30, 1988 and which is hereby incorporated herein by reference.

BACKGROUND OF THE INVENTION

The present invention relates generally to apparatus and methods for mixing cementitious materials, such as mortar and grout, and more particularly relates to portable systems for mixing these materials at construction sites.

Disclosed in copending U.S. application Ser. No. 252,379 is a portable, on-site system for batch mixing cementitious construction materials, such as mortar and grout, which has proven to be a substantial improvement over prior on-site batch mixing systems. The system includes a truck-transportable batch mixing machine operative to store and batch-mix the three components of cementitious construction material-namely, cement, sand and water. The machine supports, on a frame structure, water, cement and sand storage and dispensing vessels which, via a mixing control system described in detail in the copending application, accurately deliver predetermined quantities of these three stored constituents to a bladed batch mixer portion of the machine used to subsequently mix a desired "batch" of the resulting grout, mortar or the like for construction site use.

The relatively small truck used to deliver the batch mixing machine to the job site is also used to shuttle four cement transport containers back and forth between the mixing machine (and other mixing machines previously delivered to the job site) and a main cement storage area at the site. Each portable cement container is sized to hold a quantity of cement generally equal to that of the cement reservoir of the mixing machine into which the hopper load is dumped when necessary.

The water level in each mixing machine's water storage tank is float controlled, with the tank being elevated with respect to the batch mixer into which tank water is periodically gravity-delivered via an outlet pipe interconnected between the elevated water storage tank and the mixer.

The cement reservoir on each machine is internally provided with a rotating cement "conditioner" structure designed to maintain the stored cement therein in a condition facilitating the generally uniform outflow of stored cement from its storage reservoir into the mixer upon demand.

A large supply of sand is typically dumped on the ground adjacent each mixing machine and, as needed, portions of this large pile are scooped up into the machine's sand reservoir inlet using a front end bucket loader.

While this batch mixing system briefly described above has proven to provide substantial benefits and advantages, especially when servicing job sites with smaller volume requirements, its use has demonstrated that even further improvements therein would be desirable from economic, operational and maintenance standpoints.

Substantial economics of operation at job sites requiring greater numbers of batch volumes can be effected using in combination with the system a bulk cement storage facility which automatically delivers cement to the batch cement mixing proportioning hopper. This not only allows the cement to be purchased in truckload lots but reduces equipment and manpower costs because the use of the machine transport truck as a cement container shuttle vehicle necessarily entails additional manpower costs as does the necessity for worker handling of the relatively small containers as they are unloaded from the truck, placed atop the mixing machine, emptied into the machine's cement reservoir, and then placed back onto the truck to be shuttled back to the main cement storage area. In addition to the increased manpower costs inherent in this container shuttle procedure, a transport truck breakdown can significantly delay the overall batch mixing process. To avoid such delay, it is common practice to keep a standby truck readily available, thereby further increasing the overall cost of batch mixing cementitious materials at the construction site.

The float control system for the mixing machine water storage reservoir, while of a simple and normally quite reliable construction, is, as many float control structures are, prone to corrode, stick, and generally "gum up" with advancing age, thereby necessitating periodic replacement with its attendant cost and downtime. Moreover, when the water reservoir tank is provided with an optional water heating system, the temperature of the water in the tank tends to vertically stratify which undesirably causes variances in the temperature of water delivered to the batch mixer.

The conditioning of the cement within its machine storage and dispensing reservoir is, as was generally described above, carried out via a motor-driven rotating arm structure within the reservoir. The operation of the rotating arm structure is designed to facilitate and augment the cement conditioning or "fluffing" action of pressurized air injected into the bottom of the machine's cement reservoir. In use of the machine it has been found that some cement metering inconsistencies still exist due to the fact that the injected air tends to form within the reservoir, along essentially the entire height of the stored cement, a central vertical column of aerated cement.

This vertical column of aerated or "fluffed" cement has essentially the same effect as a liquid column that creates a pressure at its bottom which varies directly with the height of the column. Accordingly, the conditioned cement discharge rate tends to vary with the quantity of cement in the reservoir at a given time. Additionally, the rotating arm structure requires a relatively large drive motor and various related controls, and is subject to abrasion and wear from the stored cement through which it is rotated.

The batch mixer portion of the overall cementitious material mixing machine illustrated in copending U.S. application Ser. No. 252,379 is provided with a generally conventional bearing and seal structure operatively associated with the drive shaft which extends through the mixer housing. In common with the shaft bearing-/seal structures on other types of cementitious mixers, it has been found that this structure requires frequent greasing maintenance, and tends to rather quickly permit seal abrasion and resulting entry of the cementitious mixture into the shaft bearing. Such entry of the abrasive mixture into the shaft bearing, as is well known, leads to premature bearing failure.

The conventional piling of a large sand supply on the ground adjacent the mixing machine carries with it the potential problem of contaminating the cementitious mixture with earth unintentionally scooped up with sand by the front end bucket loader.

In view of the foregoing, it is accordingly an object of the present invention to provide, in the areas set forth above, improvements to the portable, on-site cementitious construction material mixing system illustrated and described in copending U.S. application Ser. No. 252,379 incorporated herein by reference.

SUMMARY OF THE INVENTION

Various aspects of the present invention, by themselves and in combinations with one another, may be utilized to provide improvements in the structure and operation of portable apparatus for the on-site mixing of cementitious construction materials such as mortar and grout. Set forth below are brief summaries of various features of the present invention. The sole purpose of the following summarization is to provide a general overview of the present invention, and is not to be construed as in any manner limiting its nature or scope.

According to one aspect of the invention, a portable, on-site cementitious construction material mixing system is provided which substantially reduces the overall cost of producing selectively sized, on-demand batches of cementitious construction material. The system includes a batch mixing machine which is generally of the type illustrated and described in copending U.S. application Ser. No. 252,379, the machine being transportable to and from the construction site on a suitable relatively small truck. Suitable cement, sand and water storage and dispensing reservoirs are incorporated in the mixing machine, and an integral control system is used to precisely meter the delivery of these three constituents into a motor-driven mixer portion of the machine which is operative to produce a predetermined batch of cementitious construction material.

To provide a main storage supply of cement immediately adjacent the mixing machine, the system is also provided with a trailerable bulk cement storage silo which may be towed behind the truck used to transport the mixing machine to the construction site. The silo is provided with a conventional screw-type conveyor to transfer cement stored therein into the integral cement storage and dispensing reservoir of the mixing machine.

Importantly, the bulk cement storage silo has a cement holding capacity at least as large as, and preferably somewhat larger than, a commercial delivery truckload of cement. The use of a bulk cement storage silo of this size advantageously eliminates the previous necessity of using the machine transport truck as a shuttle vehicle to carry smaller cement transport containers back and forth between the mixing machine and a remote on-site bulk cement storage location.

This significantly reduces both the equipment and manpower costs associated with the on-site production of batches of cementitious construction materials such as mortar and grout by enabling a commercial cement delivery truck to dump its full load, at the most economical delivery rate, into the single bulk cement storage silo immediately adjacent the mixing machine. Because the silo capacity is preferably larger (by about half) than the usual commercial delivery truckload, an ample reserve of cement may be easily maintained adjacent the mixing machine.

In a preferred embodiment thereof, the overall mixing system also includes portable sand pad means which are truck-transportable to the job site and may be placed on the ground adjacent the mixing machine. A large storage supply pile of sand is placed atop the pad means and, as required, quantities of the sand pile are scooped up and lifted into the machine's integral sand reservoir using a front end bucket loader or the like. The pad means advantageously elevate the sand pile above the ground and thus function to essentially prevent the bucket loader from scooping up dirt during the sand loading operation and undesirably contaminating the cementitious material being mixed in the machine.

According to another aspect of the present invention, the mixing machine is provided with an improved water storage system which includes a generally cylindrical water storage tank horizontally mounted on the machine at a level higher than than of the batch mixer and having a valved outlet pipe operatively connected to the mixer. An orificed water supply pipe is connected to the bottom side of the tank to regulate its fill rate.

Connected to the top side of the tank is an open-ended closure/vent pipe having gravity-operated, normally open check valve means operatively installed therein. During filling of the tank the check valve means remain open to thereby permit the rising water entering the tank to force the tank air outwardly through the closure/vent pipe. When the rising water fills the tank and upwardly enters the closure/vent pipe, the water causes the check valve means to close off the pipe, thereby causing the water in the filled tank to be brought to and maintained at full supply pressure until water is later flowed into the batch mixer through the tank outlet pipe.

When water is later flowed into the batch mixer from the water tank (at a rate faster than that of water flowed into the tank through its orificed supply pipe), water draining from the closure/vent pipe into the tank causes the check valve means to automatically open, by gravity, to permit air to enter the tank via the closure/vent pipe.

The use of the closure/vent pipe, with its gravity-opened check valve means, advantageously eliminates the previous necessity for a water level float mechanism within the tank, thereby reducing the maintenance associated with the water supply side of the overall system. In a preferred embodiment thereof, the upstanding closure/vent pipe is angled relative to vertical, and the check valve means comprise a pivotally mounted check valve member depending from an upper interior side surface of the closure/vent pipe adjacent its outer end.

When necessary or desirable, the water supply tank may be optionally provided with an improved water heating system that represents a further aspect of the present invention and is operative to substantially reduce undesirable vertical water temperature stratification within the tank. The heating system includes a combustion product flowthrough pipe which extends longitudinally through a lower side portion of the water tank somewhat above its lower interior side surface. Extending vertically through the flowthrough pipe, at spaced intervals along its length, are a series of smaller diameter water convection pipes with open upper and lower ends.

During a heating cycle, hot combustion products from a suitable flame source are flowed through the flowthrough pipe across the convection pipes therein. Combustion product heat transferred to the convection pipes produces therethrough a continuous convective upflow of heated water therethrough which enters the open lower ends of the convection pipes and is discharged through their open upper ends. The upwardly discharged water then flows to the bottom of the water tank and is again flowed upwardly through the convection pipes, thereby maintaining a generally uniform vertical water temperature distribution within the water supply tank and essentially eliminating undesirable water temperature stratification therein. Hot combustion products discharged from the flowthrough pipe may be utilized to heat the walls of the mixing machine sand reservoir, in a conventional manner, if desired.

According to another aspect of the present invention, an improved seal and bearing structure is provided for the batch mixer drive shaft at its entry into the batch mixer housing. In a preferred embodiment thereof the seal/bearing structure includes split annular packing seal means which circumscribe the drive shaft within the interior of the mixer housing and are retained against the interior side surface of the housing by a retaining plate which circumscribes the shaft and is spaced inwardly apart from the housing wall by a circumferentially spaced series of tab portions secured to the wall and permitting access to the packing seal means for installation and removal thereof. Adjustable band clamp means, accessible between the retaining plate tab portions, circumscribe the packing seal means and radially force them against the shaft.

On the outside of the mixer housing a hollow, grease-filled lubrication housing circumscribes the shaft and is continuously pressurized by a spring-loaded grease feeder to force grease inwardly along the shaft toward the packing seal means to lubricate the same. The grease housing is clamped between the mixer housing and a bearing assembly which circumscribes the shaft and rotatably supports the mixer on the shaft. Seal means within the grease housing operate to isolate the grease supply from the bearing structure.

The spring-pressurized grease supply operates to assure packing seal lubrication while at the same time creating an effective pressure barrier against the entry of abrasive cementitious material into the shaft bearing, thereby significantly prolonging the useful operating lives of the packing seal means and the shaft bearing. When the time for packing seal replacement finally arrives, packing seal replacement may be easily and quickly effected due to the unique packing seal support and retention structure described above.

According to yet a further aspect of the present invention, the cement reservoir hopper of the mixing machine is internally provided with an improved cement conditioning system designed to provide for improved cement discharge rate uniformity from the hopper. In a preferred embodiment thereof, the conditioning system includes a vertical, open-ended air discharge pipe suitably supported within the hopper above its bottom discharge opening. The open lower end of the pipe is secured to and communicates with the interior of a generally inverted pan-shaped air gatherer spaced upwardly apart from the hopper outlet.

Positioned between the hopper outlet and the air gatherer are air discharge means operative to force air upwardly toward the air gatherer to aerate or "fluff" cement falling downwardly past the periphery of the air gatherer toward the bottom hopper outlet. The discharged air reaching the air gatherer is upwardly discharged therefrom through the vertical pipe.

Importantly, the cooperation between the discharge pipe, the air gatherer, and the air discharge means essentially eliminates the elongated column of fluffed cement, associated with conventionally aerated cement conditioning systems, which causes the conditioned cement outflow rate to vary in direct proportion to the total volume of cement within the reservoir hopper. Instead, the air gatherer and discharge pipe cooperate to maintain only a relatively short (and essentially constant height) column of aerated cement below the gatherer-there is no aerated cement column above the gatherer. Accordingly, the outflow rate of conditioned cement from the hopper is generally independent of the total quantity of cement in the hopper at any particular time.

To maintain a continuous gravity flow of unconditioned cement downwardly past the periphery of the air gatherer, into the conditioning zone below the gatherer, a conventional proximity sensor is positioned within the hopper between the air discharge means and the air gatherer. In the event that downward flow of unconditioned cement past the gatherer ceases or slows sufficiently to uncover the sensor, the sensor automatically energizes an external hopper vibrator which then functions to loosen the unconditioned cement and again cause it to flow into the conditioning zone at which time the sensor operates to de-energize the vibrator. The cement conditioning system advantageously eliminates the output rate variance problems heretofore associated with elongated columns of conditioned cement, and also economically eliminates the necessity for utilizing rotating arm structures or the like within the hopper to maintain a downflow of unconditioned cement toward the bottom hopper outlet.

In an alternate embodiment of the cementitious material mixing system, the integral cement hopper/reservoir portion of the mixing machine is deleted therefrom and incorporated in the bottom end of the previously described bulk cement storage silo. Additionally, the improved cement conditioning system described above is disposed within the bulk cement storage silo, with the open upper end of the air discharge pipe being positioned adjacent the top end of the silo. A conventional screw-type conveyor is used to transfer cement from the silo directly into the batch mixer portion of the mixing machine.

DETAILED DESCRIPTION

Figure 1:
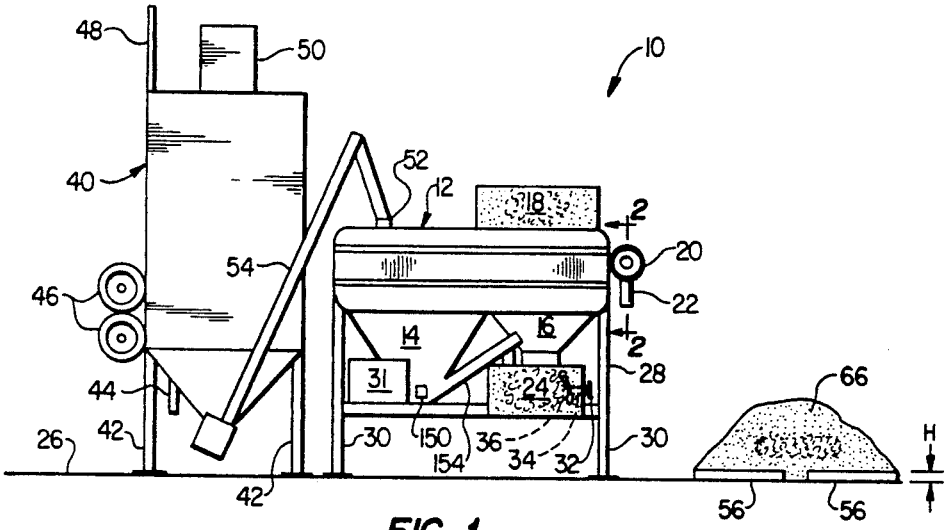
FIG. 1 is a simplified, somewhat schematic side elevational view of an improved portable on-site cementitious construction material batch mixing system embodying principles of the present invention.

Illustrated in somewhat simplified form in FIG. 1 is a portable system 10 which embodies principles of the present invention and is utilized in the batch mixing of cementitious construction material, such as mortar and grout, at a construction site. System 10 includes a mixing machine 12 which, with the important exceptions noted below, is generally similar in configuration and operation to the portable batch mixing machine illustrated and described in copending U.S. application Ser. No. 252,379 incorporated herein upon reference. The machine 12 may be transported to the construction site on a relatively small truck, and includes a cement metering hopper 14, a sand metering hopper 16, a sand storage container 18 disposed above hopper 16, a water storage tank 20 having an optional propane water heater 22, and a batch mixer 24, the aforementioned components of the machine 12 being supported in an elevated position relative to the ground 26 by a frame structure 28 having depending support legs 30.

As described in greater detail in copending U.S. application Ser. No. 252,379, and using a control system 31 also described therein, the machine 12 is operable to meter predetermined amounts of cement, sand and water from their respective mixing machine reservoirs 14, 16, and 20 into the mixer 24 to provide it with precise quantities of these three constituents for mixing therein to form a "batch" of cementitious construction material of a predetermined, selectively variable total volume.

When these three constituents are dispensed into the mixer 24, a motor 32 is used to rotate a drive shaft 34 which, in turn, rotates blades 36 within the mixer 24 to thoroughly blend the cementitious material constituents. After the batch of cementitious construction material is formed in the mixer 24, it is suitably emptied therefrom and used in the particular construction task at hand.

The illustrated system 10 also includes a portable bulk cement storage silo 40, of generally conventional construction and operation, which is provided at its bottom outlet end with support legs 42 and a bulk pneumatic filler spout 44. Operatively mounted on the left side of the silo 40 are support wheels 46, and a trailer hitch 48 and a dust collector 50 are mounted on the top end of the silo. By tipping the silo onto its left side, upon the support wheels 46, and securing the trailer hitch to the truck which is used to transport the mixing machine 12, the silo 40 may be delivered to the construction site and then tipped upwardly to its operative position, as depicted in FIG. 1, adjacent the mixing machine 12. Removably interconnected between the bottom outlet end of the silo 40 and the inlet 52 of the cement metering hopper 14 is a conventional screw-type cement conveyor 54 usable to transfer cement from within the silo 40 into the hopper 14.

Importantly, the silo 40 is sized to hold at least one commercial delivery truckload of cement, and is preferably sized to hold and store somewhat more than that amount. The cement storage capacity of the illustrated silo 40 is 900 cubic feet, a quantity which is 50% larger than the normal 600 cubic foot capacity of a standard commercial cement delivery truck.

The use in the system 10 of this single, large capacity bulk cement storage silo provides the system 10 with several advantages over, for example, the batch mixing system illustrated in copending U.S. application Ser. No. 252,379. For example, by using the large capacity silo 40, the truck used to deliver the mixing machine 12 to the job site need not be used as a shuttle vehicle to transport smaller cement containers back and forth between the machine and a central cement holding area at the construction site. This reduces both the overall equipment operation and manpower costs associated with the overall on-site batch mixing process. Additionally, the sizing of the silo 40 to receive and store at least one commercial delivery truckload of cement permits the operation to take advantage of the most economical full truckload delivery rate. Moreover, the sizing of the silo 40 to accept and store at least somewhat more than the standard delivery truckload permits an appreciable quantity of cement to be held in reserve at the machine 12 to permit flexibility in scheduled cement delivery times.

Figure 11:
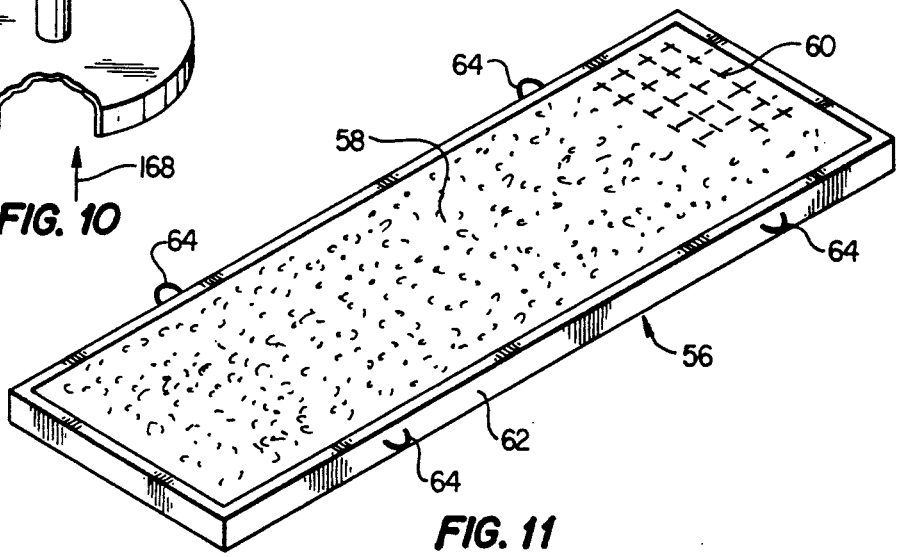
FIG. 11 is a perspective view of a portable concrete sand support slab structure used in the overall system.

Referring now to FIGS. 1 and 11, the improved batch mixing system 10 also includes a pair of elongated, portable sand support pad structures 56 which may be carried on the truck which delivers the machine 12 and the silo 40 to the construction site, and which may be placed side-by-side on the ground 26 to the right of the mixing machine 12 as illustrated in FIG. 1. As best shown in FIG. 11, each of the pad structures 56 comprises an elongated concrete slab 58 which is internally reinforced, as at 60, and is carried within a peripheral metal frame 62 conveniently provided along its long sides with lifting eyes 64.

After the pads 56 have been placed upon the ground 26 in their side-by-side position adjacent the machine 12, a large supply pile of sand 66 is deposited upon the top sides of the pads. When it becomes necessary to add sand to the hopper 16, via the top container 18, a conventional scoop bucket on a front end loader (not shown) may be utilized to scoop up sand from the pile 66 and deposit it into the container 18.

Because of the use of the sand support pads 56, this scooping and lifting operation may be performed without introducing any appreciable quantity of dirt from the ground 26 into the batch mixer 24 and contaminating the cementitious material. In this regard it can be seen that the pads 56 elevate the sand pile 66 a distance H above the ground 26 so that the sand scoop may be moved along the top surfaces of the pads, to effectively capture the sand, without scraping the ground 26 and undesirably transferring dirt into the sand metering hopper 16.

As stated above, the mixing machine 12 shown in FIG. 1 is generally similar in configuration and operation to the mixing machine disclosed in copending U.S.

application Ser. No. 252,379. However, the present invention incorporates in the machine 12 a variety of substantial improvements which will now be described.

Figure 4:
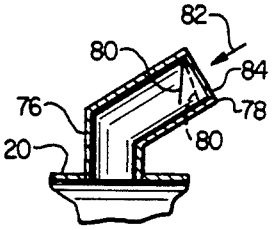
FIG. 4 is an enlarged scale cross-sectional view of the dashed circle area "B" in FIG. 2.
Figure 2:
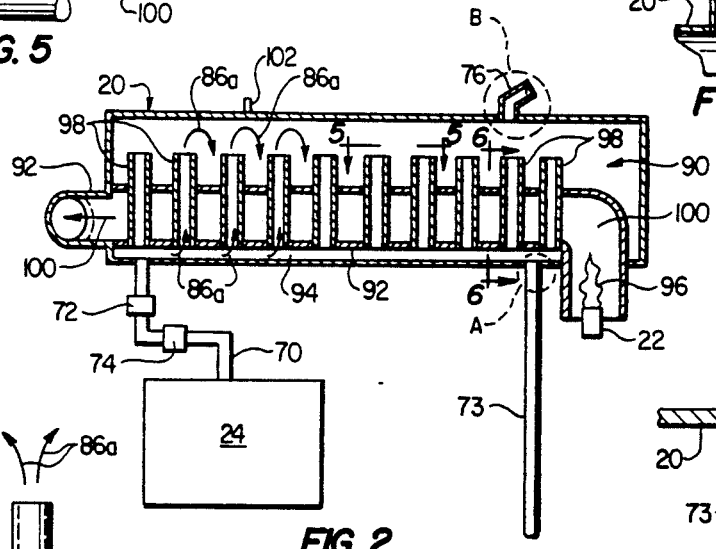
FIG. 2 is an enlarged scale cross-sectional view through the water supply storage tank portion of the system taken along line 2—2 of FIG. 1.
Figure 3:
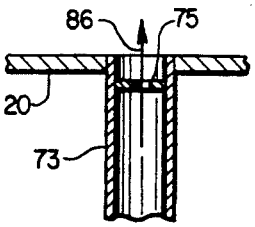
FIG. 3 is an enlarged scale cross-sectional view of the dashed circle area "A" in FIG. 2.

Referring initially to FIGS. 2–4, the water storage tank 20 is horizontally mounted on the right side of the machine 12 (as viewed in FIG. 1) at an elevation higher than that of the batch mixer 24. A supply pipe 70, having control valves 72 and 74 installed therein, is interconnected between a left bottom side portion of the tank 20 and the batch mixer 24, and is operative, via the control system 31, to deliver water stored within the tank 20 to the interior of the mixer 24.

Adjacent the right end of the tank 20, a fill pipe 73 is operatively connected to the underside of the tank and is internally provided with a metering orifice 75. Projecting upwardly from the top side of the tank 20 is an angled sealing/vent pipe 76 having an open outer end 78. Pivotally secured within the pipe end 78 is a depending check valve member 80 which, in the absence of water within pipe 76, hangs down within the pipe (as illustrated by the solid line position of the valve member in FIG. 4) to permit the entrance of air 82 into the interior of tank 20 via the angled pipe 76. From its solid line position depicted in FIG. 4, the valve member 80 is pivotable in a counterclockwise direction to its dotted line position in which it contacts a suitable seal member 84 and sealingly closes the outer end of pipe 76.

The outer end of the water fill pipe 73 is suitably connected to a construction site source of pressurized water and, during the initial filling of the tank 20, delivers the water 86 into the bottom of the tank via the metering fill orifice 75 which operates to maintain the tank fill rate at a generally constant level despite possible fluctuations in the water supply pressure.

During the filling of the tank 20, the rising water within the tank forces air outwardly from the tank via the angled pipe 76 while the check valve member 80 continues to hang in its open, solid line position depicted in FIG. 4. However, as the water 86 fills the tank and upwardly enters the pipe 76, it comes into contact with the valve member 80 and drives it to its dotted line closed position to automatically seal off the pipe 76. When this occurs, the tank water pressure rises to and is maintained at the supply water pressure.

When it is desired to flow a predetermined, metered quantity of water into the mixer 24, the valves 72, 74 are opened, via the operation of the control system 31, and water begins to flow into the mixer 24 via pipe 70. As soon as this water discharge is initiated, the water level in the angled pipe 76 begins to fall, thereby permitting the valve 80 to swing down from its dotted line closed position to its solid line open position and permitting air 82 to flow into the tank 20 via pipe 76.

This very simple and reliable water level control system advantageously eliminates the previous necessity of furnishing the tank 20 with an internal float control mechanism, and essentially eliminates the associated maintenance time and expense. The externally mounted valve member 80 is very easily and quickly accessible, and the level and fill control system of the present invention accurately maintains a predetermined water pressure and elevation head relative to mixer 24 to promote greater accuracy in metering precise amounts of water into the mixer 24.

Figure 5:
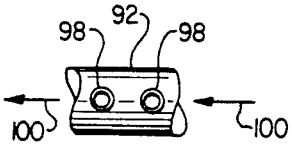
FIG. 5 is a top plan view of an interior portion of the storage tank taken along line 5—5 of FIG. 2.

In certain construction climates, it is necessary or desirable to heat the water 86 before it is delivered to the mixer 24. To achieve this water heating in an improved manner, the present invention incorporates an optional water heating system 90 which will now be described with reference to FIGS. 2, 5, and 6. The water heating system 90 includes a combustion product flowthrough pipe 92 which is of a smaller diameter than the water storage tank 20 and horizontally extends through a lower interior side portion thereof as best illustrated in FIG. 2. Pipe 92 is upwardly offset from the lower interior side surface of the tank 20, thereby defining therewith a vertical clearance space 94 within the interior of the tank.

A right end portion of the flowthrough pipe 92 is downwardly bent, extends outwardly through the bottom side of tank 20 adjacent its right end, and receives the flames 96 of the propane water heater 22. The left end of the pipe 92 extends outwardly through the left end of tank 20 as illustrated in FIG. 2. Extending vertically through the flowthrough pipe 92 are a horizontally spaced series of open-ended water convection pipes 98, each of which has a diameter substantially smaller than that of the pipe 92. Each convection pipe 98, as best illustrated in FIGS. 2 and 6, has an open upper end positioned above the flowthrough pipe 92, and an open lower end generally flush with the bottom side of pipe 92, each of the convection pipes 98 thus defining a vertical passage extending transversely through the pipe 92.

During operation of the water heating system 90, hot combustion products 100 from the burner flame 96 are flowed leftwardly through the interior of the flowthrough pipe 92 to thereby heat the convection pipes 98. The left end of the flowthrough pipe 92 is routed to the sand metering hopper 16 and appropriately connected thereto so that the combustion products 100 exiting the tank 20 heat the hopper 16, thus also heating the sand stored therein.

Figure 6:
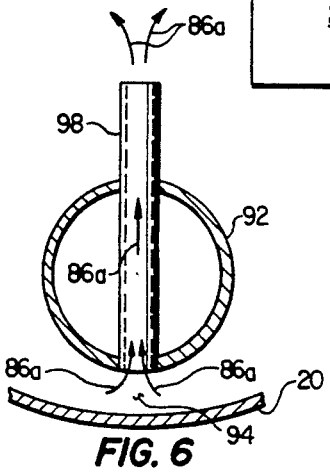
FIG. 6 is an enlarged scale partial cross-sectional view through the storage tank taken along line 6—6 of FIG. 2.

The heating of the vertical convection pipes 98 by the combustion products 100 also heats the water 86 within the pipes 98, thereby creating a convective upflow of heated water through the pipes 98 as indicated by the arrows $86_a$ in FIGS. 2 and 6. This convective upflow of heated water travels from the clearance space 94, upwardly through the pipes 98 and into the tank space above the pipes 98. As indicated in FIG. 2, heated water vertically exiting the open upper ends of the pipes 98 is flowed downwardly to the clearance space 94 and is again drawn into the open lower ends of the pipes 98. This creates a vertical convection flow cycle for the heated water which essentially eliminates undesirable vertical water temperature stratification within the tank 20. As illustrated, the upper side of the tank 20 is provided with a suitable pressure relief vent fitting 102.

Figure 7:
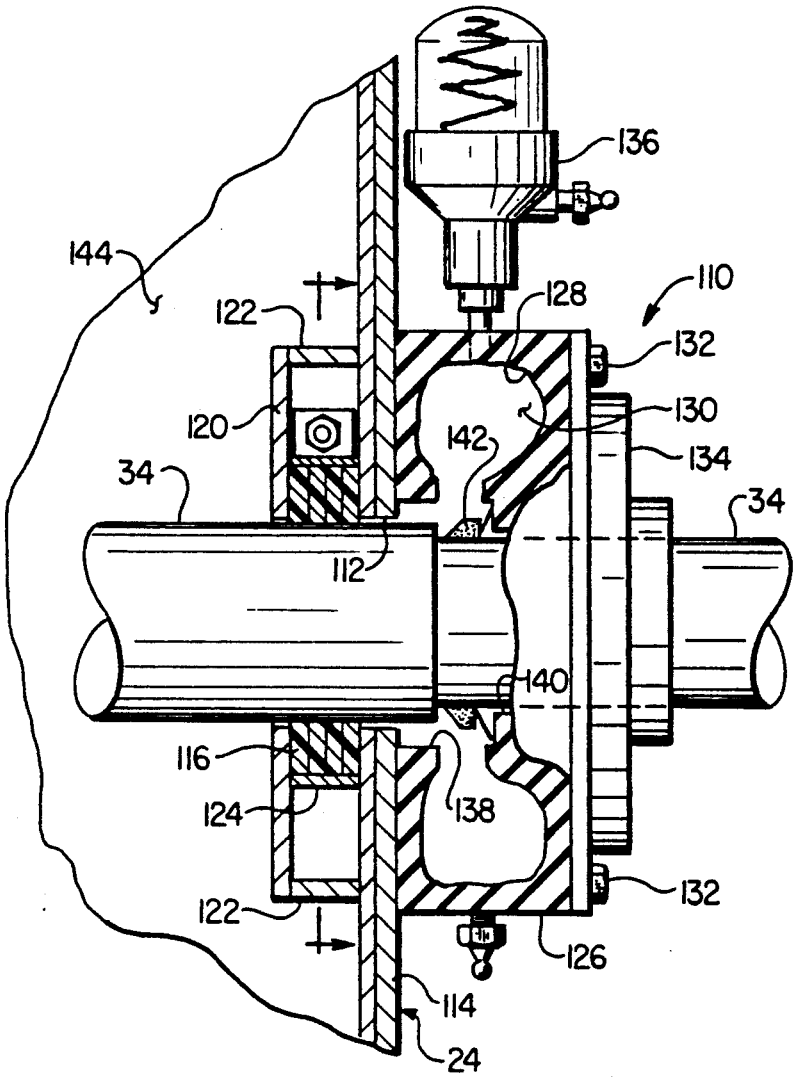
FIG. 7 is an enlarged scale partial cross-sectional view through the batch mixer portion of the system and illustrates an improved mixer shaft seal/bearing structure of the present invention.
Figure 8:
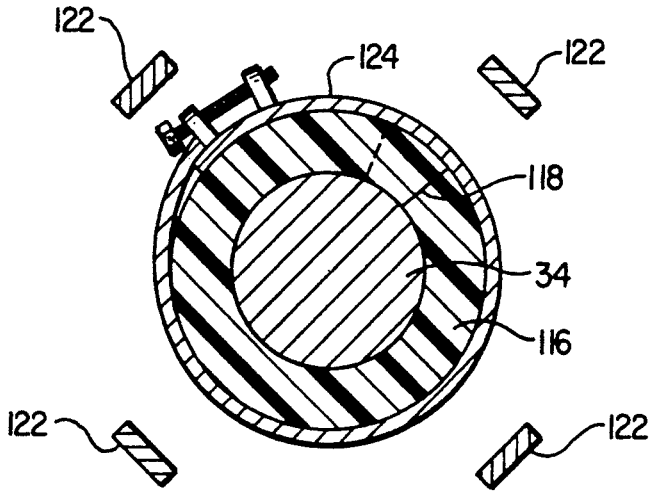
FIG. 8 is a cross-sectional view through the seal/-bearing structure taken along line 8—8 of FIG. 7.

Turning now to FIGS. 7 and 8, the batch mixer portion 24 of the mixing machine 12 is provided with an improved shaft seal and bearing structure 110 at the point at which the mixer drive shaft 34 extends through a side wall opening 112 in the housing 114 of the mixer 24. The seal/bearing structure 110 includes an annular packing seal structure 116 which is split, as at 118, and circumscribes the drive shaft 34 within the interior of the mixer housing 114. Split 118, like that in a piston ring, is radially cut at an angle relative to the axis of seal 116.

Seal structure 116 is axially held against the interior side surface of the mixer housing 114 by an annular retaining plate 120 which circumscribes the shaft 34 and is inwardly offset from the interior side surface of the housing 114 by four circumferentially spaced tab portions 122 which are welded or otherwise suitably secured to the interior side surface of the mixer housing 114. The packing seal structure 116 is held in radial contact with the shaft 34 by means of a clamping band assembly 124 which circumscribes the packing seal structure and is positioned between the retaining plate 120 and the interior side surface of the mixer housing 114.

On the outer side of the mixer housing 114 is a hollow lubrication housing 126 which circumscribes the shaft 34 and has an annular cavity 128 filled with lubricating grease 130. The lubrication housing 126, by means of suitable retaining bolts 132, is clamped between the exterior side surface of the mixer housing 114 and a bearing assembly 134 that circumscribes the shaft and rotationally supports the mixer on the shaft 34. The grease 130 within the cavity 128 of lubrication housing 126 is continuously pressurized by a spring loaded grease feeder 136 operatively mounted on the lubrication housing 126 and communicating with its interior. As illustrated in FIG. 7, the lubrication housing 126 has a left side opening 138 which circumscribes the shaft 34 and communicates with the mixer housing side wall opening 112. The lubrication housing 126 also has a right side opening 140 through which the shaft 34 passes. An annular seal member 142 positioned within the lubrication housing 126 circumscribes the shaft 34 and is operative to prevent grease 130 from flowing into the bearing assembly 134 via the right side opening 140.

Compared to conventional shaft seal/bearing structures on cementitious material mixers, the seal/bearing structure 110 of the present invention provides a variety of advantages. For example, the pressurization of the grease 130 operates to assure positive lubrication of the packing seal structure 116, thereby significantly prolonging its operating life. Additionally, the continuously pressurized grease 130 forms a highly effective barrier which essentially precludes entry of the highly abrasive cementitious material 144 from the interior of the mixer 24 into the bearing assembly 134. This, of course, protects the bearing assembly 134 against abrasion damage and significantly prolongs its operating life.

Moreover, the packing seal retention and clamping structure described above permits easy and relatively rapid changeout of the packing seal structure when required. To remove the packing seal structure 116, the band clamp assembly 124 is simply loosened and removed through the space between an adjacent pair of the retaining plate tabs 122. The split packing seal 116 is then removed through one of these tab spaces, and a new packing seal is inserted therethrough and placed around the shaft 34. The clamping band 124 is then inserted through one of these tab spaces, wrapped around the new packing seal 116 and tightened, thereby completing the packing seal replacement.

Figure 9:
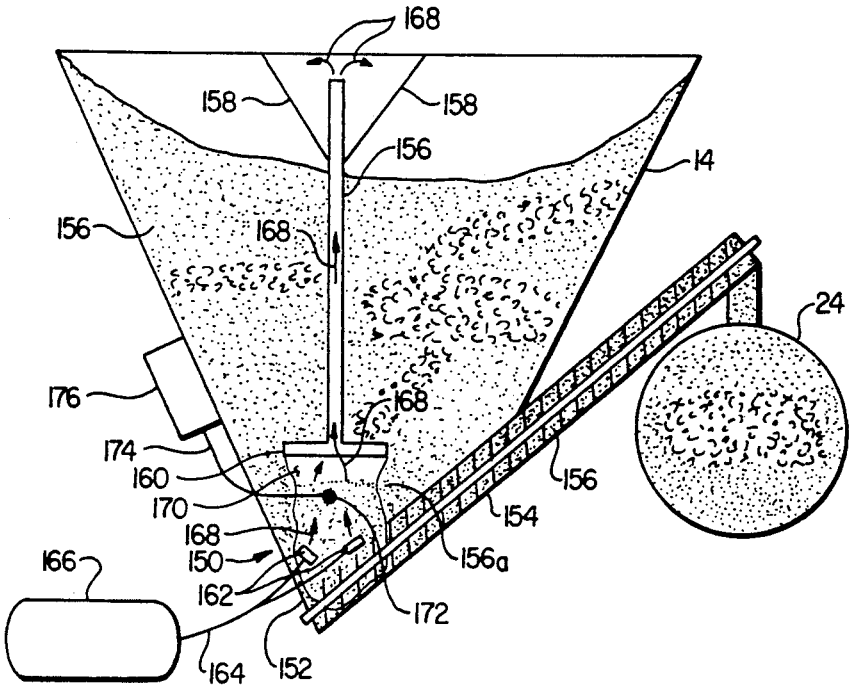
FIG. 9 is a schematic cross-sectional view through the cement dispensing and metering hopper portion of the system, and illustrates a unique cement flow consistency control portion of the system.
Figure 10:
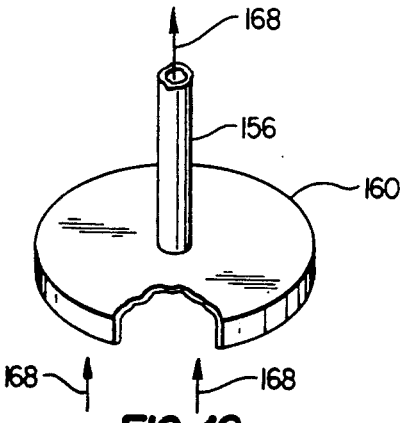
FIG. 10 is a fragmentary perspective view of an air gathering and discharge structure used in the cement flow consistency control portion.

According to a further aspect of the present invention, the cement metering hopper 14 of the mixing machine 12 is provided with a substantially improved cement metering and conditioning system 150 which will now be described in conjunction with FIGS. 9 and 10. The cement metering hopper 14 has a bottom outlet opening 152 which is connected to the inlet end of a conventional screw-type conveyor 154 operative, as shown, to transfer cement 156 from the hopper 14 into the batch mixer 24.

The cement metering and conditioning system 150 includes an elongated vertical air discharge tube or pipe 156 which is supported within the interior of the hopper 14, as by support rods 158, above the hopper outlet opening 152. The open upper end of the air discharge pipe 156 is positioned adjacent the top end of the hopper 14, while the open lower end of pipe 156 is positioned somewhat above the hopper outlet opening 152 and is secured to the upper side wall of a generally inverted pan-shaped air gatherer 160 positioned in the lower end of hopper 14 above its outlet opening 152, the lower end of pipe 156 communicating with the interior of the air gatherer 160.

Positioned below the air gatherer 160, and adjacent the hopper outlet opening 152, are a plurality of conventional screened diffusion type air discharge members 162 connected via conduit means 164 to a suitable source of pressurized air such as an air compressor 166. During metered outflow of cement 156 from the hopper 14 into the inlet of the conveyor 154, the air diffusion members 162 are operated to upwardly discharge air 168 through the cement 156 and toward the open bottom side of the air gatherer 160.

The upwardly discharged air 168 conditions or "fluffs" the cement within a relatively short conditioning zone beneath the gatherer 160 to create and maintain below the gatherer a relatively short column of conditioned cement $156_a$ which empties into the inlet of the conveyor 154 through the hopper outlet opening 152. As the conditioned cement $156_a$ empties into the conveyor 154, it is replaced with unconditioned cement 156 falling downwardly into the conditioning zone from around the periphery of the air gatherer 160. The upwardly flowing air 168 creates above the conditioned cement $156_a$ an air pocket 170 immediately below the air gatherer 160, enters the gatherer 160, and then is flowed upwardly through the pipe 156 and is discharged through its open upper end.

The pipe 156, the air gatherer 160, and the aerators 162 uniquely cooperate to substantially reduce undesirable variations in the conditioned cement outflow caused by variations in the total amount of cement 156 disposed within hopper 14. This is due to the fact that, because of the presence of the pipe 156 and the air gatherer 160, the height of the relatively short column of conditioned cement $156_a$ remains generally constant during the operation of the metering and conditioning system 150 and is essentially unaffected by variations in the total amount of cement within the hopper 14. The pipe 56 and the air gatherer 160 cooperate to, in effect, shield the large upper portion of the cement 156 above the air gatherer 160 from aeration. Accordingly, unlike conventionally aerated cement conditioning systems, the column of conditioned cement $156_a$ is at all times limited to a relatively small and essentially constant height within only a lower end portion of the hopper—regardless of the total height of stored cement in hopper 14.

A conventional proximity sensor 172 is disposed within the hopper 14 between the air gatherer 160 and the air diffusion members 162 and is connected, via a control lead 174, to a vibrator 176 externally mounted on the left side wall of the hopper 14. As long as the sensor 172 is covered by conditioned cement $156_a$, the vibrator 176 is de-energized. However, in the event that the sensor 172 is uncovered, due to cessation or slowing of unconditioned cement flow into the conditioning zone beneath the gatherer 160, the sensor operates to energize vibrator 176 to thereby loosen the unconditioned cement 156 and again, as intended, cause it to flow into the conditioning zone from around the periphery of the air gatherer 160. In this manner, the cement metering and conditioning system 150 of the present invention provides for more uniform outflow metering of conditioned cement into the conveyor 154 and eliminates the need for internal cement agitation means such as rotating arm structures or the like.

Figure 12:
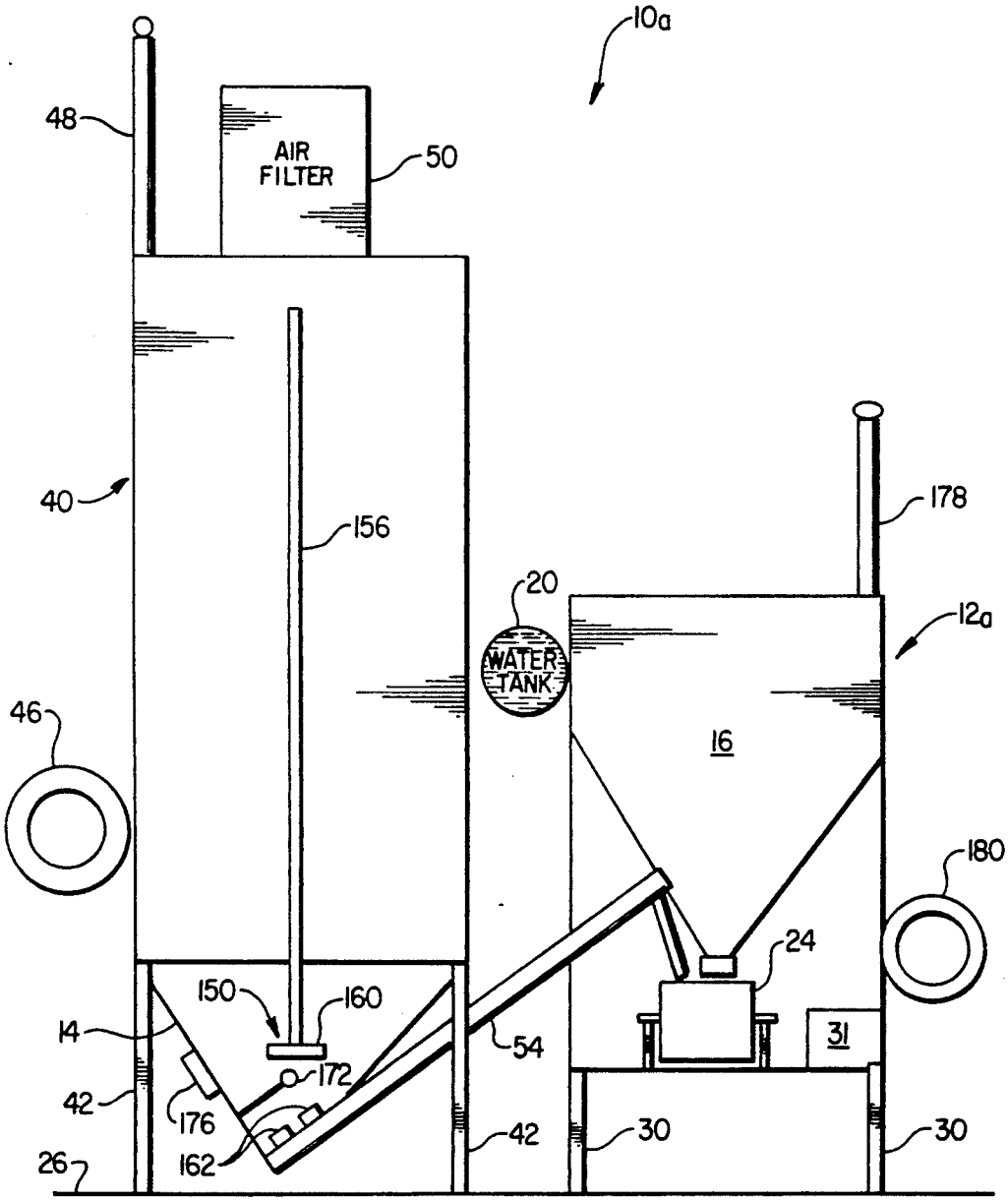
FIG. 12 is a schematic side elevational view of an alternate embodiment of the batch mixing system illustrated in FIG. 1.

An alternate embodiment $10_a$ of the batch mixing system 10 is illustrated in FIG. 12 with components similar to those in system 10 (FIG. 1) being given identical reference numerals for ease of comparison to their counterparts in system 10. In the modified system $10_a$, the integral cement hopper 14 of the mixing machine $12_a$ is deleted therefrom and incorporated, as shown, in the bottom of the trailerable bulk cement storage silo 40. The screw type conveyor 54 is routed directly from the cement hopper 14 at the bottom of silo 40 to the batch mixer 24.

The previously described cement conditioning system 150 is positioned in hopper 14, with the air discharge pipe 156 being extended upwardly within the silo 40 to adjacent its top end. A suitable trailer hitch 178 is secured to the top end of mixing machine $12_a$ so that, like silo 40, it can be towed to the construction site by the transport vehicle. Although the sand support pads 56 (FIG. 1) are not illustrated in FIG. 12, it will be readily be appreciated that they can be advantageously utilized in the modified system $10_a$.

While various features of the present invention have been representatively illustrated and described in a cementitious material mixing setting, it will be readily appreciated that, if desired, they could be advantageously utilized in other applications. For example, the improved conditioning and metering system could also be used to improve the hopper outflow rate uniformity for particulate materials other than cement. Additionally, the water storage, metering and heating improvements could readily be incorporated in a variety of other liquid handling systems. Similarly, it will also be appreciated that the usefulness and advantages of the improved shaft seal/bearing system are not limited to cementitious material applications, such system, or portions thereof, being also readily adaptable for use in conjunction with other types of containers, materials and shaft applications.

The foregoing detailed description is to be clearly understood as being given by way of illustration and example only, the spirit and scope of the present invention being limited solely by the appended claims.

What is claimed is:

1. Apparatus, transportable by a road vehicle to a construction site, for economically and accurately mixing predetermined proportional amounts of cement, sand and water constituents of cementitious construction materials into selectively variable batch volumes of mix at a construction site, said transportable apparatus comprising:

a cementitious material mixing machine transportable by the road vehicle to the construction site and including:

batch mixer means for receiving cement, said and water constituents, mixing the received constituents, and discharging the resulting mixture batch for use, cement hopper means for storing on the machine a dispensable supply of cement, sand hopper means for storing on the machine a dispensable supply of sand, and control means operative to select a total, selectively variable volume of the cementitious construction material batch to be mixed and then automatically cause the proportional amounts of cement and sand necessary to form the batch to be mixed to be respectively dispensed into said batch mixer means from said cement hopper means and said sand hopper means;

pad means, transportable by the road vehicle to the construction site and being positionable on the ground adjacent said mixing machine, for underlying and supporting a large bulk supply pile of sand, quantities of which may be periodically scoop loaded from atop said pad means into said sand hopper means to replenish their dispensable sand supply, said pad means serving to elevate the sand pile above the ground and thereby substantially lessen the possibility that dirt will be scooped up with the sand pile quantities and contaminate the sand in said sand hopper means; and bulk cement storage container means transportable by the road vehicle to the construction site and adapted to be positioned and left in place adjacent said mixing machine, said bulk cement storage container means being operative to hold and store at least one commercial delivery truckload of cement, said bulk cement storage container means having associated therewith conveyor means connectable to said cement hopper means and selectively operable to transfer cement into said cement hopper means from said bulk cement storage container means, whereby cement may be commercially delivered to and deposited in the in-place bulk cement storage container means, in economical commercial delivery truckload quantities, thereby eliminating the necessity of using either the road vehicle or associated construction site worker time to periodically replenish the stored cement supply at the transportable apparatus.

2. The transportable apparatus of claim 1 further comprising:

pad means, transportable by the road vehicle to the construction site and being positionable on the ground adjacent said mixing machine, for underlying and supporting a large bulk supply pile of sand, quantities of which may be periodically scoop loaded from atop said pad means into said sand hopper means to replenish their dispensable sand supply, said pad means serving to elevate the sand pile above the ground and thereby substantially lessen the possibility that dirt will be scooped up with the sand pile quantities and contaminate the sand in said sand hopper means.

3. The transportable apparatus of claim 2 wherein said pad means include a plurality of elongated concrete pads.

4. The transportable apparatus of claim 3 wherein each of said plurality of elongated concrete pads is supported within a peripheral metal frame having a plurality of lifting eyes secured thereto.

5. The transportable apparatus of claim 1 wherein:

said bulk cement storage container means include a cement storage silo trailerable by the road vehicle, said cement storage silo having support wheels operatively mounted on a side thereof, and a trailer hitch secured thereto and operatively connectable to the road vehicle.

6. The transportable apparatus of claim 1 wherein:
said bulk cement storage container means are sized to hold substantially more than one commercial delivery truckload of cement.

7. The transportable apparatus of claim 6 wherein:
said bulk cement storage container means are sized to hold approximately one and one half commercial delivery truckloads of cement.

8. The transportable apparatus of claim 7 wherein:
said bulk cement storage container means have a cement storage capacity of approximately 900 cubic feet.

9. A method of economically and accurately producing selectively variably sized individual batches of cementitious material at a construction site, said method comprising the steps of:
utilizing a road vehicle to transport a cementitious material mixing machine to the construction site, said mixing machine having:
batch mixer means for receiving cement, sand and water constituents, mixing the received constituents, and discharging the resulting mixture batch for use,
cement hopper means for storing on the machine a dispensable supply of cement,
sand hopper means for storing on the machine a dispensable supply of sand,
control means operative to select a total, selectively variable volume of the cementitious material batch to be mixed and then automatically cause the proportional amounts of cement and sand necessary to form the batch to be mixed to be respectively dispensed into said batch mixer means from said cement hopper means and said sand hopper means;
utilizing the road vehicle to transport a bulk cement storage silo to the construction site, said bulk cement storage silo being sized to hold at least one commercial delivery truckload of cement;
operatively positioning said bulk cement storage silo adjacent said mixing machine; depositing an initial quantity of cement in said bulk cement storage silo;
interconnecting conveyor means between said bulk cement storage silo and said cement hopper means, said conveyor means being selectively operable to transfer cement from said bulk cement storage silo into said cement hopper means;
respectively depositing initial dispensable quantities of cement and sand into said cement hopper means and said sand hopper means;
operating said control means and said batch mixer means to produce and discharge separate batches of cementitious material;
periodically operating said conveyor means to replenish the dispensable supply of cement within said cement hopper means; and
periodically deposit full commercial delivery truckloads of cement into said bulk cement storage silo to replenish its stored supply of cement.

10. The method of claim 9 further comprising the steps of:
utilizing a road vehicle to transport sand support pad means to the construction site;
horizontally positioning the sand support pad means on the ground adjacent said mixing machine;
depositing a large supply pile of sand atop the horizontally positioned sand support pad means; and
periodically replenishing the dispensable sand supply in said sand hopper means by scooping up quantities of sand from said sand supply pile and depositing said sand quantities into said sand hopper means.

11. Apparatus, transportable by a road vehicle to a construction site, for economically and accurately mixing predetermined proportional amounts of cement, said and water constituents of cementitious construction materials into selectively variable batch volumes of mix at the construction site, said transportable apparatus comprising:
a cementitious material mixing machine transportable by the road vehicle to the construction site and including:
batch mixer means for receiving cement, said and water constituents, mixing the received constituents, and discharging the resulting mixture batch for use, and
sand hopper means for storing on the machine a dispensable supply of sand,
bulk cement storage container means transportable by a road vehicle to the construction site and adapted to be positioned and left in place adjacent said mixing machine, said bulk cement storage container means being operative to hold and store at least one commercial delivery truckload of cement, said bulk cement storage container means having associated therewith conveyor means connectable to said batch mixer means and selectively operable to transfer cement into said batch mixer means from said bulk cement storage container means; and
control means operative to select a total, selectively variable volume of the constituents construction material batch to be mixed and then automatically caused the proportional amounts of cement and sand necessary to form the batch to be mixed to be respectively dispensed into said batch mixer means form said bulk cement storage container means and said sand hopper means;
said bulk cement storage container means including a cement storage silo having a bottom outlet through which cement stored in said silo may be dropped into said conveyor means for delivery thereby to said batch mixer means, and wherein said transportable apparatus further comprises;
means for selectively creating and maintaining an essentially constant rate of gravity outflow f stored cement to said outlet opening despite variations in the total quantity of i said silo, said means for selectively creating and being operative to: generally upwardly aerate the cement in a conditioning zone, through which the aerated cement may fall outwardly said outlet opening, and
permit the non-aerated cement to fall into the conditioning zone, during aerated cement outflow from said silo, replace the exiting aerated cement and in turn be aerated conditioned for gravity outflow from said silo.

12. The transportable apparatus of claim 11 wherein said bulk cement storage container means include a cement storage silo having a bottom outlet through which cement stored in said silo may be dropped into said conveyor means for delivery thereby to said batch mixer means, and wherein said transportable apparatus further comprises:

means for selectively creating and maintaining an essentially constant rate of gravity outflow of stored cement through said outlet opening despite variations in the total quantity of cement in said silo, said means for selectively creating and maintaining being operative to:

generally upwardly aerate the cement only in a conditioning zone, through which the aerated cement may fall outwardly through said outlet opening, which extends upwardly from adjacent said outlet opening and upwardly terminates within a bottom portion of said silo, and permit the nonaerated cement to fall into the conditioning zone, during aerated cement outflow from said silo, to replace the exiting aerated cement and in turn be aerated and conditioned for gravity outflow from said silo.

13. The transportable apparatus of claim 12 further comprising:

a vibrator mounted on said silo, and means, responsive to a predetermined shortening of the height of cement within said conditioning zone, for energizing said vibrator to facilitate transfer of nonaerated cement into said conditioning zone.

14. The transportable apparatus of claim 12 wherein said means for selectively creating and maintaining include:

air conduit means supported in a generally vertical orientation within said silo above said outlet opening, said air conduit means having an open upper end positioned adjacent the top of said silo, and an open lower end positioned in a lower end portion of said silo and spaced upwardly apart from said outlet opening, air gathering means, secured to said open lower end of said air conduit means and defining a transverse enlargement thereof, for intercepting an upwardly directed flow of air and causing the intercepted air to be flowed upwardly through said air conduit means and be discharged through their open upper end, and air discharge means, positioned within said silo between said outlet opening and said air gathering means, for receiving pressurized air from a source thereof and discharging the received air upwardly in a manner causing it to be intercepted by said air gathering means.

15. The transportable apparatus of claim 14 further comprising:

a vibrator mounted on said silo, and proximity sensor means disposed in said conditioning zone between said air gathering means and said air discharge means, said proximity sensor means being operative to sense an undesirable fall in the level of cement within said conditioning zone and responsively energize said vibrator to thereby assist the flow of nonaerated cement into said conditioning zone.

16. The transportable apparatus of claim 14 wherein:

said air discharge means include a plurality of screened air diffusion members.

17. The transportable apparatus of claim 14 wherein:

said air gathering means include a generally inverted pan-shapedair gathering member having a top wall secured to said open lower end of said air conduit means, the interior of said air gathering member communicating with the interior of said air conduit means.

18. Apparatus, transportable by a road vehicle to a construction site, for economically and accurately mixing predetermined proportional amounts of cement, sand and water constituents of cementitious construction materials into selectively variable batch volumes of mix at a construction site, said transportable apparatus comprising:

a cementitious material mixing machine transportable by the road vehicle to the construction site and including:

batch mixer means for receiving cement, said and water constituents, mixing the received constituents, and discharging the resulting mixture batch for use, cement hopper means for storing on the machine a dispensable supply of cement, sand hopper means for storing on the machine a dispensable supply of sand, and control means operative to select a total, selectively variable volume of the cementitious construction material batch to be mixed and then automatically cause the proportional amounts of cement and sand necessary to form the batch to be mixed to be respectively dispensed into said batch mixer means from said cement hopper means and said sand hopper means;

bulk cement storage container means transportable by the road vehicle to the construction site and adapted to be positioned and left in place adjacent said mixing machine, said bulk cement storage container means being operative to hold and store at least one commercial delivery truckload of cement, and said bulk cement storage container means having associated therewith conveyor means connectable to said cement hopper means and selectively operable to transfer cement into said cement hopper means form said bulk cement storage container means; said bulk cement storage container means including a cement storage silo having a bottom outlet through which cement stored in said silo may be dropped into said conveyor means for delivery thereby to said batch mixer means and means for selectively creating and maintaining an essentially constant rate of gravity outflow of stored cement to said outlet opening despite variations in the total quantity of in said silo, said means for selectively creating and being operative to:

generally upwardly aerate the cement in a conditioning zone, through which the aerated cement may fall outwardly said outlet opening, and permit the non-aerated cement to fall into the conditioning zone, during aerated cement outflow from said silo, replace the exiting aerated cement and in turn be aerated conditioned for gravity outflow from said silo;

whereby cement may be commercially delivered to and deposited in the in-place bulk cement storage container means, in economical commercial delivery truckload quantities, thereby eliminating the necessity of suing either the road vehicle or associated construction site worker time to periodically replenish the stored cement supply at the transportable apparatus.

19. An apparatus, transportable by a road vehicle to a construction site, for mixing predetermined constituents of construction materials, including particulate matter and cement, in a batch mixer having desired volume of mix selected from a range of volumes, the apparatus comprising:

a batch mixer for mixing a batch of cementitious material having predetermined volumetric size;

an operator control means including a volume selector input means for an operator to select a desired total volume of cementitious material to be mixed by the batch mixer from a range of available batch sizes, the operator control means being responsive to the volume selector means for automatically controlling delivery of necessary quantities of constituents for the batch of cementitious material to a batch mixer and mixing of a batch of cementitious material in the selected desired total volume with predetermined proportions of constituents;

particulate matter storage means for holding a dispensable supply of particulate matter;

a first conveyor having an entrance coupled with a lower end of the particulate matter storage means for creating a relatively consistent volumetric flow of particulate matter, the first conveyor being responsive to the control means for operating at a predetermined speed to produce a predetermined volumetric flow of particulate matter for a predetermined time interval, the operator control means determining the predetermined time interval for operation of the conveyor to deliver at the predetermined volumetric flow rate a volume of particulate matter in predetermined proportion to the selected desired total volume of the batch of cementitious material;

cement storage means for holding a dispensable supply of cement; the cement storage means including a bulk cement storage container means transportable by the road vehicle to the construction site and adapted to be positioned and left in place adjacent the batch mixer, the bulk cements storage container being operative to hold and store at least one commercial delivery truckload of cement; the bulk cement storage container means further including means for selectively creating and maintaining an essentially constant rate of gravity outflow of stored cement through the lower end of the cement storage means to the second conveyor despite variations in the total quantity of cement in the bulk cement storage means, the means for selectively creating and maintaining being operative to:

generally upwardly aerate the cement in a conditioning zone, through which the aerated cement may fall outwardly through the lower end of the bulk cement storage means, and permit the non-aerated cement to fall into the conditioning zone during aerated cement outflow from the bulk cement storage means to replace the exiting aerated cement and in turn be aerated and conditioned for gravity outflow from the bulk cement storage means; and a second conveyor having an entrance coupled with a lower end of the cement storage means for creating a relatively consistent volumetric flow of cement, the second conveyor being responsive to the operator control means for operating at a predetermined speed to produce a predetermined volumetric flow of cement for a predetermined time interval, the control means determining the time interval for operation of the second conveyor to deliver at the predetermined volumetric flow rate a volume of cement in predetermined proportion to the selected desired total volume of the batch of cementitious material.

20. A method of accurately and thoroughly mixing a batch of cementitious material having a selected volume and predetermined ratio of particulate matter, cement and water, suitable for use at a construction site, the method comprising the steps of:

providing at the construction site a batch mixer for mixing as a batch cementitious material and having a predetermined range of mixing volumes, a downwardly converging cement storage means and a cement conveyor means cooperating the cement storage means to create a predetermined rate of volumetric flow of cement from the cement supply means to the batch mixer, a downwardly converging particulate matter storage means and particulate matter conveyor cooperating with the particulate matter storage means to create a predetermined rate of volumetric flow of particulate matter between the particulate matter storage means and the batch mixer, and a water supply for delivering selectable volumes of water to the batch mixer;

providing for storage of bulk amounts of cement in the cement storage means and particulate matter in the particulate matter storage means in order to mix a batch of cementitious material when needed over a given period of time without the need to replenish the cement and particulate matter after each mixing and to safely store the material at the construction site;

providing operator preselection of a desired total batch volume of cementitious material from a range of batch sizes of cementitious material to be mixed as a batch by the batch mixer under control of a control means, the control means determining a time interval of operation of the cement conveyor and the particulate matter conveyor corresponding to the selected desired total volume to deliver to the batch mixer at the respective predetermined volumetric rates volumes of the particulate matter and the cement to create a batch of cementitious material in the batch mixer having a predetermined ratio and the desired total volume;

providing automatic operation with the control means of the cement conveyor and the particulate matter conveyor for the determined time interval; and providing operation with the control means of the batch mixer to mix the delivered constituents.

21. The method of claim 20 further comprising the step of providing automatic operation with the control means of the water supply to deliver a volume of water for the preselected desired total volume of the batch of cementitious material.

22. The method of claim 20 further including the step of replenishing the particulate matter storage means with particulate matter.

23. A method of economically and accurately producing selectively variably sized individual batches of cementitious material at a construction site, said method comprising the steps of:

utilizing a road vehicle to transport a cementitious material mixing machine to the construction site, said mixing machine having:

batch mixer means for receiving cement, particulate matter and water constituents, mixing the received constituents, and discharging the resulting mixture batch for use, and particulate matter hopper means for storing on the machine a dispensable supply of particulate matter, and control means;

utilizing the road vehicle to transport a bulk cement storage silo to the construction site, said bulk cement storage silo being sized to hold at least one commercial delivery truckload of cement;

operatively positioning said bulk cement storage silo adjacent said mixing machine;

depositing an initial quantity of cement in said bulk cement storage silo; interconnecting conveyor means between said bulk cement storage silo and said batch mixer means, said conveyor means being selectively operable to transfer cement from said bulk cement storage silo into said cement hopper means; depositing initial dispensable quantities of particulate matter into said particulate matter hopper means; operating said control means and said batch mixer means to produce and discharge separate batches of cementitious material; the control means operative to select a total, selectively variable volume of the cementitious material batch to be mixed and then automatically cause the proportional amounts of cement and particulate matter necessary to form the batch to be mixed to be respectively dispensed into said batch mixer means from said bulk cement storage silo and said particulate matter hopper means; and periodically depositing full commercial delivery truckloads of cement into said bulk cement storage silo to replenish its stored supply of cement.

24. The method of claim 23 further comprising the step of periodically replenishing the particulate matter hopper means with a supply of particulate matter for dispensing.

25. An apparatus, transportable by a road vehicle to a construction site, for mixing predetermined constituents of construction materials, including sand and cement, in a batch mixer having desired volume of mix selected from a range of volumes, the apparatus comprising:

a batch mixer for mixing a batch of cementitious material having predetermined volumetric size;

an operator control means including a volume selector input means for an operator to select a desired total volume of cementitious material to be mixed by the batch mixer from a range of available batch sizes, the operator control means being responsive to the volume selector means for automatically controlling delivery of necessary quantities of constituents for the batch of cementitious material to a batch mixer and mixing of a batch of cementitious material in the selected desired total volume with predetermined proportions of constituents;

sand storage means for holding a dispensable supply of sand;

a first conveyor having an entrance coupled with a lower end of the sand storage means for creating a relatively consistent volumetric flow of sand, the first conveyor being responsive to the control means for operating at a predetermined speed to produce a predetermined volumetric flow of sand for a predetermined time interval, the operator control means determining the predetermined time interval for operation of the conveyor to deliver at the predetermined volumetric flow rate a volume of sand in predetermined proportion to the selected desired total volume of the batch of cementitious material;

cement storage means for holding a dispensable supply of cement;

a second conveyor having an entrance coupled with a lower end of the cement storage means for creating a relatively consistent volumetric flow of cement, the second conveyor being responsive to the operator control means for operating at a predetermined speed to produce a predetermined volumetric flow of cement for a predetermined time interval, the control means determining the time interval for operation of the second conveyor to deliver at the predetermined volumetric flow rate a volume of cement in predetermined proportion to the selected desired total volume of the batch of cementitious material; and a bulk cement storage container transportable by the road vehicle to the construction site and adapted to be positioned and left in place adjacent the batch mixer, the bulk cement storage container being operative to hold and store at least one commercial delivery truckload of cement, the bulk cement storage container having associated therewith a third conveyor connectable to the cement storage container; the bulk cement storage container further including means for selectively creating and maintaining an essentially constant rate of gravity outflow of stored cement through the lower end of the cement storage means to the second conveyor despite variations in the total quantity of cement in the bulk cement storage means, the means for selectively creating and maintaining being operative to:

generally upwardly aerate the cement in a conditioning zone, through which the aerated cement may fall outwardly through the lower end of the bulk cement storage means, and permit the non-aerated cement to fall into the conditioning zone during aerated cement outflow form the bulk cement storage means to replace the exiting aerated cement and in turn be aerated and conditioned for gravity outflow from the bulk cement storage means.

26. An apparatus, transportable by a road vehicle to a construction site, for mixing predetermined constituents of construction materials, including sand and cement, in a batch mixer having desired volume of mix selected from a range of volumes, the apparatus comprising:

a batch mixer for mixing a batch of cementitious material having predetermined volumetric size;

an operator control means including a volume selector input means for an operator to select a desired total volume of cementitious material to be mixed by the batch mixer from a range of available batch sizes, the operator control means being responsive to the volume selector means for automatically controlling delivery of necessary quantities of constituents for the batch of cementitious material to a batch mixer and mixing of a batch of cementitious material in the selected desired total volume with predetermined proportions of constituents;

sand storage means for holding a dispensable supply of sand;

a first conveyor having an entrance coupled with a lower end of the sand storage means for creating a relatively consistent volumetric flow of sand, the first conveyor being responsive to the control means for operating at a predetermined speed to produce a predetermined volumetric flow of sand for a predetermined time interval, the operator control means determining the predetermined time interval for operation of the conveyor to deliver at the predetermined volumetric flow rate a volume of sand in predetermined proportion to the selected desired total volume of the batch of cementitious material;

cement storage means for holding a dispensable supply of cement;

a second conveyor having an entrance coupled with a lower end of the cement storage means for creating a relatively consistent volumetric flow of cement, the second conveyor being responsive to the operator control means for operating at a predetermined speed to produce a predetermined volumetric flow of cement for a predetermined time interval, the control means determining the time interval for operation of the second conveyor to deliver at the predetermined volumetric flow rate a volume of cement in predetermined proportion to the selected desired total volume of the batch of cementitious material; and pad means, transportable by the road vehicle to the construction site and being positionable on the ground adjacent said mixing machine, for underlying and supporting a large bulk supply pile of and, quantities of which may be periodically scoop loaded from atop said pad means into said sand storage means to replenish a dispensable and supply, said pad means serving to elevate the sand pile above the ground and thereby substantially lessen the possibility that dirt will be scooped up with the sand pile quantities and contaminate the sand in said sand hopper means.

* * * * *

UNITED STATES PATENT AND TRADEMARK OFFICE

CERTIFICATE OF CORRECTION

PATENT NO. : 5,203,628

DATED : April 20, 1993

INVENTOR(S) : Hamm

It is certified that error appears in the above-identified patent and that said Letters Patent is hereby corrected as shown below:

On title page, item [56],
Under "U.S. Patent Documents", add --4,624,575, 11/1986, Lantz, 366/20--.

In column 4, line 20, delete "than than" and add --than that--.

In column 15, line 27, after "sand," add --and--.

In column 15, line 58, delete "deposit" and add --depositing--.

In column 16, line 40, delete "form" and add --from--.

In column 16, line 49, delete "f" and add --of--.

In column 16, line 51, delete "i" and add --in--.

In column 17, line 7, delete "only."

In column 17, beginning with line 10, delete "which extends upwardly from adjacent said outlet opening and upwardly terminates within a bottom portion of said silo,."

In column 18, line 37, delete "form" and add --from--.

In column 18, line 61, delete "suing" and add --using--.

In column 22, line 27, after "storage", add --means and selectively operable to transfer cement into the cement storage means from the bulk cement storage--.

UNITED STATES PATENT AND TRADEMARK OFFICE

CERTIFICATE OF CORRECTION

PATENT NO. : 5,203,628

DATED : April 20, 1993

INVENTOR(S) : Hamm

It is certified that error appears in the above-identified patent and that said Letters Patent is hereby corrected as shown below:

In column 22, line 41, delete "form" and add --from--.

In column 24, line 10, delete "and" (2nd occurrence) and add —sand—.

In column 24, line 13, delete "and" and add --sand--.

Signed and Sealed this

Twentieth Day of December, 1994

*Attest:*

Bruce Lehman

BRUCE LEHMAN

*Attesting Officer*

*Commissioner of Patents and Trademarks*